US009765440B2

(12) United States Patent
Curran et al.

(10) Patent No.: US 9,765,440 B2
(45) Date of Patent: Sep. 19, 2017

(54) CORROSION AND EROSION-RESISTANT MIXED OXIDE COATINGS FOR THE PROTECTION OF CHEMICAL AND PLASMA PROCESS CHAMBER COMPONENTS

(71) Applicant: Keronite International Limited, Haverhill (GB)

(72) Inventors: James Curran, Haverhill (GB); Stephen Hutchins, Haverhill (GB); Oleg Dunkin, Haverhill (GB)

(73) Assignee: Keronite International Limited, Haverhill, Suffolk (GB)

( * ) Notice: Subject to any disclaimer, the term of this patent is extended or adjusted under 35 U.S.C. 154(b) by 324 days.

(21) Appl. No.: 14/264,896

(22) Filed: Apr. 29, 2014

(65) Prior Publication Data

US 2014/0318974 A1 Oct. 30, 2014

(30) Foreign Application Priority Data

Apr. 29, 2013 (GB) ..... 1307709.4

(51) Int. Cl.

| | |
|---|---|
| ***C25D 11/02*** | (2006.01) |
| ***C25D 11/04*** | (2006.01) |
| ***C25D 11/18*** | (2006.01) |
| ***C25D 11/20*** | (2006.01) |
| ***C25D 11/24*** | (2006.01) |
| ***C25D 11/26*** | (2006.01) |
| ***C25D 11/30*** | (2006.01) |
| ***C25D 11/06*** | (2006.01) |
| *C25D 13/02* | (2006.01) |

(52) U.S. Cl.

CPC ..... *C25D 11/02* (2013.01); *C25D 11/024* (2013.01); *C25D 11/026* (2013.01); *C25D 11/06* (2013.01); *C25D 11/18* (2013.01); *C25D 11/24* (2013.01); *C25D 11/26* (2013.01); *C25D 11/30* (2013.01); *C25D 13/02* (2013.01)

(58) Field of Classification Search

CPC ..... C25D 11/026; C25D 11/18; C25D 11/20
See application file for complete search history.

(56) References Cited

U.S. PATENT DOCUMENTS

| | | | | |
|---|---|---|---|---|
| 5,264,113 | A | 11/1993 | Bartak et al. | |
| 5,585,189 | A * | 12/1996 | Inoue | B05D 7/14 106/412 |
| 6,896,785 | B2 | 5/2005 | Shatrov et al. | |
| 2003/0188972 | A1 | 10/2003 | Shatrov et al. | |
| 2008/0086195 | A1 * | 4/2008 | Atanasoka | C23C 26/00 623/1.15 |
| 2009/0223450 | A1 | 9/2009 | Moriya et al. | |
| 2011/0297319 | A1 | 12/2011 | Chen et al. | |
| 2011/0319986 | A1 | 12/2011 | Bayer et al. | |
| 2012/0000783 | A1 * | 1/2012 | Suda | C25D 11/04 205/50 |

FOREIGN PATENT DOCUMENTS

| | | | |
|---|---|---|---|
| CN | 101928974 | A | 12/2010 |
| CN | 102747403 | A | 10/2012 |
| JP | 1205094 | | 8/1989 |
| TW | 557642 | B | 10/2003 |
| WO | 9628591 | | 9/1996 |
| WO | 9705302 | | 2/1997 |
| WO | 9931303 | | 6/1999 |
| WO | 03016596 | A1 | 2/2003 |
| WO | 03083181 | A2 | 10/2003 |
| WO | 2007092611 | A2 | 8/2007 |
| WO | 2008045184 | A1 | 4/2008 |

OTHER PUBLICATIONS translation of WO 97/05302 published in 1997.*
Combined Search and Examination Report, dated Jul. 30, 2013 for corresponding GB 1307709.4, filed Apr. 29, 2013 (8 pgs.).
Curran et al., "Porosity in Plasma Electrolytic Oxide Coatings," Acta Materiallia v.54, pp. 1985-1993, http://dx.doi.org/10.1016/j.actamatt.2005.12.029.
Examination Report from counterpart United Kingdom Application No. GB1307709.4, dated May 19, 2016, 3 pp.

* cited by examiner

*Primary Examiner* — Brian W Cohen
(74) *Attorney, Agent, or Firm* — Shumaker & Sieffert, P.A.

(57) ABSTRACT

There is disclosed a method for producing corrosion and erosion-resistant mixed oxide coatings on a metal substrate, as well as a mixed oxide coating itself. A surface of the substrate metal is oxidized and converted into a first coating compound comprising a primary oxide of that metal by a plasma electrolytic oxidation (PEO) process. One or more secondary oxide compounds comprising oxides of secondary elements not present in conventional alloys of the substrate metals at significant (>2 wt %) levels are added to the first oxide coating. The source of the secondary element(s) is at least one of: i) a soluble salt of the secondary element(s) in the electrolyte; ii) an enrichment of the surface of the substrate metal with secondary element(s) prior to PEO processing; and iii) a suspension of the secondary element(s) or oxide(s) of the secondary element(s) applied to the oxide of the metal after this has been formed by the PEO process.

19 Claims, No Drawings

CORROSION AND EROSION-RESISTANT MIXED OXIDE COATINGS FOR THE PROTECTION OF CHEMICAL AND PLASMA PROCESS CHAMBER COMPONENTS

This application claims priority to GB Application No. 1307709.4, filed Apr. 29, 2013, which is incorporated by reference herein in its entirety.

TECHNICAL FIELD

This invention relates to continuous surface layers of mixed oxide formed by plasma electrolytic oxidation (PEO) processes, components provided with such surface layers and to processes of application of such surface layers.

BACKGROUND

Vacuum deposition processes, and in particular the fabrication of semiconductor-based integrated circuits for microelectronic or nanoelectronic devices (such as microprocessors, memory chips), generally involve plasma processes for cleaning, material deposition, patterning, material removal and doping. The chambers within which such plasma processes are performed are expected to present "clean", chemically inert surfaces to minimise interference with the operations being performed and the devices being fabricated. The process chambers themselves, and components used within them such as electrodes, wafer support tables, gas inlets and outlets, are therefore made from a wide variety of materials ranging from stainless steel to ceramics such as quartz, alumina, and silicon carbide. Metallic components of such process chambers are generally made from stainless steel, with aluminium also being used, although there are material limitations and preferences depending on the exact processes to be conducted (e.g. the chemical environments to which the surfaces are exposed), and even depending on the materials being processed. Where aluminium is used, it is often anodised to present a more chemically inert, corrosion-resistant and plasma-erosion resistant surface. In some cases, where the protection offered by anodising is insufficient, metal components are even plasma sprayed with more erosion-resistant ceramics such as yttria or yttria-alumina cermets (see, for example, U.S. 2009/223450 and TW 557642).

Anodising of aluminium is generally used to enhance the corrosion and erosion-resistance of aluminium component surfaces. "Hard anodising" is particularly effective at this, and is the preferred means of enhancing the usable lifetime of components with aluminium surfaces exposed to plasma erosion or corrosion. Hard anodising is typically performed in a chilled bath of concentrated sulphuric acid (10-20 wt % $H_2SO_4$), with anodic potentials of between 30 and 90V applied to the aluminium surfaces at current densities of between 320 and 970 A/m$^2$ (30 and 90 A/ft$^2$). All forms of anodising grow aluminium oxide ($Al_2O_3$) by oxidation of the aluminium substrate. The aluminium oxide is amorphous and has a fine-scale columnar pore structure which is maintained by substrate dissolution during the anodising process. The scale of this porosity is minimised by the conditions of hard anodising, resulting in pore diameters of <100 nm. On rough surfaces, and particularly sharp convex radiuses (<100 μm), the coating is generally microstructurally defective, with opening cracks, because the simple, linear columnar growth process cannot compensate for the absence of sufficient substrate source material for an expanding volume of coating as it grows outwards on such a radius. Anodising is also limited to certain preferred substrate alloys because certain substrate alloying elements such as Cu, and precipitates such as silicates interfere with the formation of a uniform coating.

Numerous PEO technologies exist, including processes available from Magnesium Technologies Licensing, Ltd., Auckland, New Zealand, under the trade designation Anomag (WO 96/28591, and WO03/016596), processes available from Technology Applications Group, Grand Forks, N. Dak., under the trade designation Tagnite (U.S. Pat. No. 5,264,113) for surface treatment of magnesium, and processes available from Keronite Group, Ltd., Cambridge, United Kingdom, under the trade designation Keronite (WO99/31303, WO03/083181, U.S. Pat. No. 6,896,785) for protection of aluminium magnesium and titanium alloys. With regard to the coating of magnesium and its alloys, the afore-mentioned Anomag and Tagnite processes result only in amorphous magnesium phosphate coatings, whereas the specific process parameters of the Keronite process (as detailed for example in WO03/083181) generates crystalline MgO in the periclase form. The Keronite process has previously been used for the protection of disposable aluminium liners for protection of components in plasma process chambers (WO2007/092611), with electrolytes and process conditions being specifically formulated to give highly crystalline alumina with minimal incorporation of undesirable elements such as copper or potassium. If sufficient longevity can be achieved, it would be possible to dispense with the use of liners altogether, and to rely on a PEO coating alone, directly applied to plasma chamber components. Numerous PEO technologies exist, including Anomag (WO 96/28591, and WO 03/016596), Tagnite (U.S. Pat. No. 5,264,113) for surface treatment of magnesium, and Keronite (WO99/31303, WO03/083181, U.S. Pat. No. 6,896,785) for protection of aluminium magnesium and titanium alloys. With regard to the coating of magnesium and its alloys, the afore-mentioned Anomag and Tagnite processes result only in amorphous magnesium phosphate coatings, whereas the specific process parameters of the Keronite process (as detailed for example in WO03/083181) generates crystalline MgO in the periclase form. The Keronite process has previously been used for the protection of disposable aluminium liners for protection of components in plasma process chambers (WO2007/092611), with electrolytes and process conditions being specifically formulated to give highly crystalline alumina with minimal incorporation of undesirable elements such as copper or potassium. If sufficient longevity can be achieved, it would be possible to dispense with the use of liners altogether, and to rely on a PEO coating alone, directly applied to plasma chamber components.

The Keronite PEO process can generate the crystalline oxides of whatever substrate (or 'parent') metal is used. That is to say that on aluminium alloys, it will produce crystalline phases of $Al_2O_3$; on magnesium alloys, it will produce crystalline MgO; on titanium alloys, it will produce crystalline $TiO_2$, and so on. Some of these crystalline oxide phases present good resistance to erosion by reactive plasmas (notably $\alpha$-$Al_2O_3$, $\gamma$-$Al_2O_3$ and MgO periclase for resistance to fluorine based plasmas), but it has been found that the addition to the coating of other oxide phases such as $Y_2O_3$, $Er_2O_3$ or $Dy_2O_3$ would be preferable for further improved plasma resistance and for coating longevity in a reactive plasma environment. Clearly, some modification of the coating process is necessary to incorporate significant levels of any such "secondary" oxide phases into the coating—that is to say additional oxide phases based on elements that are not present at significant levels (>2 wt %) in the parent/substrate metal.

It is noted that most PEO processes will inherently form what could be regarded as "mixed oxides": for example, on aluminium alloys, a mixture of amorphous alumina with $\alpha$-$Al_2O_3$ and $\gamma$-$Al_2O_3$, would be formed, additionally incorporating alloying elements such as silicon and copper into the oxide; generally as impurities in the amorphous phase of alumina. With respect to the present invention, however, such oxides would simply be regarded as aluminium oxide with impurities, and would all be considered to be within the "primary oxide", in this example, the oxide of the original aluminium alloy substrate. Similarly, on magnesium-aluminium alloys such as AZ91, a mixture of magnesium aluminium spinel, together with magnesium oxide might be formed by PEO processing, but for the purposes of the present invention, this inherent mixture of oxides formed simply by oxidation of the substrate would again be considered the "primary oxide". Typical PEO process electrolytes often include compounds such as silicates or phosphates to promote growth and deposition of oxide, and these may become included in the coating as silicates or phosphates which might again be regarded as "mixed oxides". Again, however, for the purpose of this invention, they are regarded as part of the primary PEO system (of standard electrolyte and substrate alloy): they exit purely to facilitate growth of an oxide on any given substrate and are not as deliberate and unusual "secondary" additions for the express purpose of creating a mixture of oxide phases with enhancing resistance to attack by particular chemical species (such as fluorine ions).

Suspensions of oxide powders within the PEO electrolyte are considered within WO 2007/092611 as a means of obtaining coating compositions other than the oxide of the parent metal (i.e. oxides other than alumina in the case of aluminium surfaces). However, that approach has proved to be of limited commercial use. Powders and colloids are typically poorly dispersed within the electrolyte, giving rise to non-uniform coatings. They also result in unacceptably high levels of erosion in the necessary recirculation systems for cooling and agitating the electrolyte. Embodiments of the present invention seek to address these problems by incorporating secondary additions (for example yttrium or other similar elements known to produce beneficial oxides) into the PEO coating by other means.

SUMMARY

Viewed from one aspect, there is provided a method for producing corrosion and erosion-resistant mixed oxide coatings on a substrate made of metal, wherein a surface of the substrate metal is oxidised and converted into a first coating compound comprising a primary oxide of that metal by a plasma electrolytic oxidation (PEO) process, and wherein one or more secondary oxide compounds comprising oxides of secondary elements not present in conventional alloys of the substrate metals at significant (>2 wt %) levels is added to the first oxide coating, the source of the secondary element(s) being at least one of:

i) a soluble salt of the secondary element(s) in the electrolyte;

ii) an enrichment of the surface of the substrate metal with secondary element(s) prior to PEO processing;

iii) a suspension of the secondary element(s) or oxide(s) of the secondary element(s) applied to the oxide of the metal after this has been formed by the PEO process.

The present invention relates to the addition of substantially different "secondary oxides", based on one or more, different, "secondary" elements such as yttrium, that are not present at significant levels (>2 wt %) as conventional alloying elements of aluminium or magnesium, and do not constitute standard electrolytes for PEO processing of a given alloy, but have instead been deliberately added to the oxide to enhance corrosion, and plasma erosion resistance—for example because a mixture of $Y_2O_3$ and $Al_2O_3$ is known to present superior resistance to erosion by fluorine based plasma than the mixture of aluminium oxides and impurities inherently formed by PEO processing of any aluminium alloy on its own.

Advantageously, the secondary elements are present in an amount so as to constitute greater than 3 wt % of the resulting oxide layer (i.e. wt % of the oxide layer, neglecting the stoichiometric contribution from oxygen); preferably greater than 4 wt % and most preferably greater than 5 wt %.

The process is useful for the protection of metal surfaces of components for use in plasma or chemical processing chambers, or metal surfaces of the chambers themselves.

The PEO process may be a pulsed bi-polar PEO process, for example as described in WO99/31303 or WO03/083181.

The substrate metal may comprise aluminium, or an alloy thereof, in which case the first, primary oxide coating may comprise amorphous or crystalline alumina (the latter in either the $\alpha$-$Al_2O_3$ or $\gamma$-$Al_2O_3$ form, or mixtures thereof) or mixtures thereof, such as are formed by the PEO process.

Alternatively, the substrate metal may comprise magnesium, or an alloy thereof, in which case the first, primary oxide coating may comprise amorphous oxides, crystalline MgO periclase, or mixtures thereof, such as are formed by the PEO process.

Alternatively, the substrate metal may comprise a magnesium-aluminium alloy (such as AZ91), in which case the first, primary oxide coating may comprise, amorphous oxides, crystalline MgO periclase, or magnesium aluminium spinels, and any mixtures thereof, such as are formed by the PEO process.

Alternatively, the substrate metal may comprise titanium, in which case the first, primary oxide coating may comprise crystalline forms of $TiO_2$ such as anatase or rutile, or mixtures thereof, such as are formed by the PEO process.

Alternatively, the substrate metal may comprise yttrium, in which case the first, primary oxide coating may comprise crystalline $Y_2O_3$ formed by the PEO process.

The substrate metal may comprise predominantly magnesium, titanium zirconium, hafnium, tantalum, yttrium, or any other metal which can be subjected to plasma electrolytic oxidation. For instance, components with a magnesium surface will oxidise to produce an MgO periclase surface, which is again resistant to fluorine-based plasmas, and this could again be further enhanced by the incorporation of a secondary oxide such as yttria.

The secondary element(s) may be a transition metal such as scandium, zirconium or manganese; a rare earth metal such as tantalum or hafnium; a lanthanoid such as erbium, dysprosium, lanthanum or cerium; an alkaline earth metal such as magnesium or strontium; or another metal such as indium or gallium; or even a non-metal such as silicon or boron.

In a preferred embodiment, where the substrate metal is aluminium, magnesium or titanium, the PEO process is performed in an electrolyte comprising yttrium nitrate (or any other soluble salts of yttrium) to provide a source of yttrium for formation of yttria. The yttrium (or complexes of yttrium) are drawn to the first metal surface by electrophoresis and are fused into the first metal oxide coating by local plasma discharges.

Alternatively or in addition, the substrate metal surface may be enriched with yttrium prior to the PEO processing. This may be achieved by any surface treatment method, with examples including (but not limited to) physical or chemical vapour deposition, by sputtering, by ion implantation, by diffusion, by electrochemical deposition, by laser alloying, or by hot-dipping in an yttrium-enriched alloy.

Alternatively or in addition, yttria may be incorporated by a secondary, separate step of applying an yttria suspension (such as an yttria sol) by spraying or by dip/immersion, such that a layer of yttria may be deposited on the rough outer surface of the PEO coating, and/or into the pore structure presented by the PEO coating.

A low voltage (<50V) electrophoretic process may be used to promote deposition and incorporation of the yttria onto and into the pre-existing PEO coating.

The yttria sol may be further physically stabilised by a subsequent step of thermal curing.

The relative phase proportions of the secondary oxide (e.g. yttria) and the oxide of the substrate metal as a function of depth from the coating surface may be varied, tailored or adjusted. For instance, the surface may be yttria-rich relative to the bulk of the oxide coating, especially where an yttria suspension is applied after the initial PEO processing step. Alternatively, a region of the coating near the substrate interface may be enriched relative to the bulk in embodiments where the electrolyte is enriched with soluble salts of yttrium.

Alternatively, where the substrate comprises a metal other than magnesium, then the secondary element may be magnesium. Magnesium and/or its corresponding oxide magnesia (in the periclase form) could be incorporated into the PEO coating by the same process(es), and would provide enhanced resistance to fluorine based plasma.

Viewed from another aspect, there is provided a corrosion and erosion-resistant mixed oxide coating on a substrate made of metal, the coating comprising primary oxide(s) of the substrate metal, such as are formed by a plasma electrolytic oxidation (PEO) process in any typical electrolyte, and also secondary oxide phases comprising elements that are not typically found in significant levels (>2 wt %) in either the substrate metal alloys or conventional PEO electrolytes, the source of the secondary oxide being at least one of:

i) a soluble salt of the secondary elements in the electrolyte;

ii) an enrichment of the surface of the substrate metal with the secondary elements prior to PEO processing;

iii) a suspension of the secondary elements or compounds of the secondary elements applied to the oxide of the substrate metal after this has been formed by the PEO process.

The corrosion and erosion-resistant mixed oxide coating is useful for the protection of metal surfaces of components for use in plasma or chemical processing chambers, or metal surfaces of the chambers themselves. Preferred embodiments of the coating comprise a mixture of yttria and alumina as produced by the methods described above, a mixture of periclase and alumina, and a mixture of periclase and yttria.

In the present processes, plasma electrolytic oxidation (PEO), preferably in the pulsed bi-polar form used in WO03/083181, can be used to overcome many of the limitations of conventional anodising (or hard anodising) with respect to the protection of metal surfaces against chemical corrosion and plasma erosion, for applications in chemical and plasma process environments. The Keronite PEO processes generate a continuous layer of crystalline or semi-crystalline oxide on any metal which forms a rectifying oxide. This includes any alloys of aluminium, magnesium, titanium, zirconium, yttrium, tantalum, niobium, hafnium and many other metals. Thin surface layers of such metals may also be applied to other metals such as stainless steel which cannot otherwise be successfully processed using PEO technology. In embodiments of the present invention, the process is applied directly to the surface of the process chambers or of components for use within process chambers, rather than to disposable liners as in WO2007/092611. This innovation is made possible by the greater durability achieved by tailoring the oxide compositions for optimal or at least improved resistance to plasma erosion.

The crystallinity of the oxide which is intrinsically formed as a result of a pulsed bipolar PEO process itself presents greater resistance to erosion by many reactive plasma environments than the mere amorphous oxides achieved by conventional anodising (or indeed other PEO processes such as Tagnite or Anomag). Notable examples of this include the resistance of either $\alpha$-$Al_2O_3$ or $\gamma$-$Al_2O_3$ to fluorine-based plasmas, and the resistance of MgO periclase to hydrogen-based plasmas. However, these oxides are not necessarily optimal for plasma resistance and can be improved upon by incorporation of other oxide phases into the coating.

In order to optimise the crystalline phase compositions for resistance to any given reactive plasma environment, some embodiments incorporate $Y_2O_3$ (or oxides of other similar elements which would not normally be present at significant levels in aluminium alloys) into the oxide coating that is formed by the oxidation of a metal surface by pulsed bi-polar plasma electrolytic oxidation. This is achieved by enrichment of the substrate surface prior to PEO processing, during the PEO process by using soluble additions to the electrolyte, or by a subsequent application.

The relative phase proportions of the primary and secondary oxides as a function of the depth from the coating surface may be varied, tailored or adjusted. For instance, the surface might be relatively rich in the secondary oxide, compared to the bulk of the primary oxide coating—as would typically result from the method of the first aspect with the source of the secondary elements being of type (i) and (iii). Alternatively, the region of the coating near the substrate interface may be enriched relative to the bulk, primary oxide by the method of the first aspect with the source of the secondary elements being of type (ii).

In certain embodiments, the surface of the mixed oxide coating may be polished, abraded, ablated or otherwise have an upper layer thereof partially removed after its formation on the substrate. This can be useful when there is a concentration gradient of the secondary oxide across a thickness of the coating from the substrate interface towards the surface. By removing a predetermined thickness of the coating by polishing, abrading, ablating or otherwise treating the surface thereof, the concentration of secondary oxides at the surface can be tailored to specific applications. In some embodiments, the surface properties of the coating are changed by adjusting the concentration of secondary oxides at the surface in this manner. Polishing, abrading or ablating the surface may serve to increase or decrease the concentration of secondary oxides at the surface depending on the direction of the concentration gradient.

DETAILED DESCRIPTION

The Keronite plasma electrolytic oxidation process (WO99/31303, WO03/083181, U.S. Pat. No. 6,896,785) has been recognised as a means of enhancing the erosion resistance of aluminium surfaces—most notably in the form of disposable aluminium liners for plasma process chambers in WO2007/092611, which exploits the ability of the PEO process to form the $\alpha$-$Al_2O_3$ "corundum" crystalline phase of aluminium oxide for resistance to fluorine-based plasmas.

In the present invention, new combinations of mixed oxides have been developed for improved plasma erosion resistance. These include, for example, the afore-mentioned alumina as a primary oxide, but with the enhancement of the addition of yttria. Sufficient longevity is achieved with the present invention for it to be possible to dispense with the use of liners altogether, and to rely on a PEO coating alone, directly applied to plasma chamber components.

The degree of process control offered by the Keronite PEO process makes it possible to generate the crystalline oxides of whatever substrate (or 'parent') metal is used. That is to say that on aluminium alloys, it will produce crystalline phases of $Al_2O_3$, (including the $\alpha$-$Al_2O_3$ phase already successfully exploited in WO2007/092611), but also wider possibilities such as pure $\gamma$-$Al_2O_3$, whilst on magnesium alloys, it is possible to form crystalline MgO periclase, and on titanium alloys, anatase or rutile $TiO_2$ can be formed. Each of these phases offers improved erosion protection under the conditions of certain reactive plasma environments.

In addition to the pure crystalline oxide phases of the substrate metals described above, it is also known that the addition to the coating of other crystalline oxide phases such as $Y_2O_3$, $Er_2O_3$ or $Dy_2O_3$ would be preferable for improved plasma resistance and for coating longevity in certain reactive plasma environments. Clearly, some modification of the coating process is necessary to incorporate oxide phases that are not present in the parent/substrate metal into the oxide coating.

As discussed in the background, in WO2007/092611, the incorporation of nanopowders as suspension in the PEO process electrolyte was described as a possible means of achieving this, but that approach has proven to be of limited commercial use. Powders and colloids are typically poorly dispersed within the electrolyte, giving rise to non-uniform coatings. Only very low levels of incorporation are generally observed, since the pressure waves resulting from microplasma development tend to physically displace any suspended solids away from the surface. The use of suspensions also results in unacceptably high levels of erosion in the necessary recirculation systems for cooling and agitating electrolyte. The present invention addresses this by incorporating yttrium (or other similar elements known to produce beneficial oxides) into the PEO coating by other means.

These include the use of certain soluble compounds which are compatible with the PEO electrolyte systems. For instance, yttrium nitrate may be added to a typical KOH based electrolyte. Other suitable soluble compounds include (but are not limited to) phosphates, halides, carbonates, sulphates, sulfonates, sulphides, perchlorates, and a number of organic compounds such as acetates, acetylacetonates, isopropoxides, methoxyethoxides, ethylhexanoates, napthanates, napthoates, and pentanedionates.

The yttrium (or complexes of yttrium) is drawn to the metal surface by electrophoresis and are dissociated and fused into the alumina coating by local plasma discharges.

A second means of incorporating yttria into the coating is to perform a secondary, separate step of applying an yttria suspension (such as an yttria sol), such that a layer of yttria may be deposited on the rough outer surface of the PEO coating, and/or into the pore structure presented by the PEO coating. This exploits the range of fine scale, surface connected porosity presented by typical PEO coatings ["Porosity in plasma electrolytic oxide coatings", J. A. Curran and T. W. Clyne, Acta Materialia v. 54, p 1985-1993 http://dx.doi.org/10.1016/j.actamat.2005.12.029]. The yttria suspension may be deposited by processes such as spraying, but is preferably achieved by a dip (immersion) process. A low voltage (<100V) electrophoretic process may then additionally be used to promoted deposition of the yttria, and to promote incorporation of the yttria onto and into the pre-existing PEO coating. After applying yttria via such a secondary process step, the yttria sol may be physically stabilised by a subsequent step of thermal curing. For instance, in a preferred aspect, the component may be held at 120° C. for 30 minutes.

A third means of incorporating yttria into the PEO coating is to enrich the substrate metal surface with yttrium prior to the PEO processing. This may be achieved by additions of yttrium to a bulk alloy during manufacture, or by such surface treatment processes as physical or chemical vapour deposition, by sputtering, by ion implantation, by electrochemical deposition, or by hot-dipping in an yttrium-enriched alloy.

The various means of adding yttria to the PEO coating described above allow various concentration profiles of yttria to be achieved through the thickness of the coating. For instance the surface may be yttria-rich relative to the bulk of the oxide coating—as would typically result from the incorporation of soluble yttrium compounds into the PEO process electrolyte, and particularly the method involving secondary deposition of yttria into and onto the porous structure of a pre-existing PEO coating. Alternatively, the region of coating near the substrate interface may be enriched relative to the bulk—this may be achieved by PEO processing metals that have been surface-enriched with yttrium.

Example 1: Yttria Enhancement of a-Al2O3 Coating for Fluorine-Etch Resistance Components for the reaction chamber for a standard Si etch process involving $SF_6$ gas are to be made from aluminium alloy AA6082. The benchmark material for surface etch rate in this application is hard anodised aluminium. Under the accelerated test parameters used to evaluate this product, this hard anodising is etched at approximately 85 nm/min.

Representative test pieces were processed in an aqueous electrolyte comprising 2 g/l KOH, with the components exposed to positive potentials at 480V and with 70 microsecond pulse duration, and negative pulses of 400V with 1000 microsecond duration The selection of a 480V limit for the positive potential again ensures that microdischarges are constrained to 15 mA peak power and that the duration of the discharges is constrained to ~50 microseconds. Processing under these conditions for 20 minutes results in a 35±3 μm coating that is at least 93% crystalline (by volume), and consists of a mixture of $\alpha$-$Al_2O_3$ and $\gamma$-$Al_2O_3$.

Under accelerated etch rate test conditions, the etch rate of this coating was approximately 35 nm/min: just over twice as etch resistant as the incumbent hard anodising technology.

Samples were also produced under the same conditions, but with the addition of 1 g/l of yttrium nitrate to the electrolyte. This resulted in incorporation of 12 atomic % Y into the coating (as evaluated by surface energy dispersive spectroscopy), in the form of $Y_2O_3$-concentrated near the outer surface.

Under the accelerated etch rate test conditions, the etch rate of this yttria-enhance coating was <10 nm/min—demonstrating a substantial improvement over the standard crystalline alumina coating.

Example 2: Periclase Coating for Resistance to Fluorine-Based Plasmas, and Enhancement by Electrophoretic Deposition of Yttria Components for the reaction chamber for a standard Si etch process involving $SF_6$ gas are to be made from magnesium alloy AZ91D. The benchmark material for surface etch rate in this application is hard anodised aluminium. Under the accelerated test parameters used to evaluate this product, this hard anodising is etched at approximately 85 nm/min.

The magnesium components are coated using an aqueous electrolyte comprising 0.02M sodium orthophosphate, with 480V positive pulses of 80 microsecond duration at 1 kHz frequency. The ~25 μm thick coating resulting from 8 minutes of processing is 74% crystalline in the periclase phase of MgO. The etch rate of this coating was approximately 20 nm/min under the accelerated test conditions—making it four times superior to the incumbent hard anodising technology in terms of plasma etch resistance.

Further samples were processed as per the above conditions, but with subsequent immersion in an yttria sol. Electrophoretic deposition of yttria onto the surface was promoted using a 50V potential, for 10 minutes. Samples were then heat treated at 130° C. for 30 minutes. This resulted in a surface enriched with yttria (to ~35 atomic % Y, as evaluated by surface energy dispersive spectroscopy), in the form of $Y_2O_3$, again concentrated on the outer surface of the coating.

Under the accelerated etch rate test conditions, the etch rate of this yttria-enhance coating was ~10 nm/min—demonstrating a substantial improvement over the standard crystalline alumina coating, and also further enhancement of the periclase coating's performance by the addition of the yttria secondary oxide.

Example 3: Chlorine Plasma-Resistant Coating for AA7075, Comprising Alumina and Silica Components for a GaN processing chamber are to be manufactured from aluminium. The more aggressive etch processes include exposure to chlorine based plasma at high bias. To test surface erosion resistance, a mixture of $BCl_3$ and $Cl_2$ at flow rates of 10 and 90 standard cubic centimeters per minute respectively, at a pressure of 15 mT is used under a high DC bias of ~500V. Under such test conditions, typical etch rates for aluminium surfaces are of the order of 125 nm/min.

For protection against this plasma etching, chamber components consisting of 7075 aluminium were processed in an aqueous electrolyte comprising 2 g/l KOH, and 10 g/l $Na_2SiO_3$ with the components exposed to positive potentials at 490V and with 80 microsecond pulse duration, and negative pulses of 400V with 1000 microsecond duration The selection of a 490V limit for the positive potential ensures that microdischarges are constrained to 15 mA peak power. This results in more intense injection of energy into the oxide coating, and in turn, the greatest degree of phase transformation from amorphous oxides (the product of conventional anodising) to crystalline oxide. The duration of the resulting discharges is also intrinsically constrained to ~50 microseconds.

Processing under these conditions for 20 minutes results in a 48±4 μm coating consists of a mixture of $\gamma$-$Al_2O_3$ and $SiO_2$.

Under the etch conditions described above, this coating shows negligible etch (<10 nm) even after 300 minutes of exposure. It is thus vastly superior to conventional anodising.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for producing corrosion and erosion-resistant mixed oxide coatings on a metal substrate, wherein the metal substrate comprises a substrate metal and less than 2 wt % of a secondary element chosen from transition metals, rare earth metals, lanthanoids, and combinations thereof, the method comprising:

oxidizing a surface of the metal substrate by a plasma electrolytic oxidation (PEO) process in an electrolyte to form on the surface a first oxide coating comprising an oxide of the substrate metal, incorporating into the first oxide coating one or more oxides of the secondary elements to form the mixed oxide coating, wherein the oxides of the secondary elements are incorporated into the first oxide coating by at least one of:

i) enriching the surface of the substrate with the secondary element(s) prior to the oxidizing step that forms the first oxide coating wherein the surface of the metal substrate is enriched with the secondary element(s) by physical or chemical vapor deposition, by sputtering, by ion implantation, by electrochemical deposition, or by hot-dipping in an alloy enriched with the secondary element(s); and ii) applying a suspension of the oxide(s) one or more of the secondary element(s) to the first oxide coating after the first oxide coating has been formed in the oxidizing step; and wherein the relative phase proportions of the oxides of the substrate metal and the oxides of the secondary elements in the mixed oxide coating vary as a function of depth from an exterior surface thereof.

2. The method according to claim 1, wherein the secondary elements are present in the mixed oxide coating in an amount greater than 3 wt %, neglecting any stoichiometric contribution from oxygen.

3. The method according to claim 1, wherein the secondary elements are present in the mixed oxide coating in an amount greater than 4 wt %, neglecting any stoichiometric contribution from oxygen.

4. The method according to claim 1, wherein the secondary elements are present in the mixed oxide coating in an amount greater than 5 wt %, neglecting any stoichiometric contribution from oxygen.

5. The method according to claim 1, wherein the PEO process is a pulsed bi-polar PEO process.

6. The method according to claim 1, wherein the substrate metal comprises aluminium or an aluminium alloy, in which case the first oxide coating comprises crystalline alumina (in either the $\alpha$-$Al_2O_3$ or $\gamma$-$Al_2O_3$ form or a mixture thereof), formed from the aluminium or aluminium alloy by the PEO process.

7. The method according to claim 1, wherein the substrate metal comprises magnesium or a magnesium alloy, in which case the first oxide coating comprises crystalline MgO periclase, as formed from the magnesium by the PEO process.

8. The method according to claim 1, wherein the substrate metal comprises a magnesium-aluminium alloy, in which case the first oxide coating comprises crystalline $MgAl_2O_4$ spinel, MgO periclase, or a mixture thereof, as formed from the magnesium-aluminium alloy by the PEO process.

9. The method according to claim 1, wherein the substrate metal comprises titanium or a titanium alloy, in which case the first oxide coating comprises crystalline forms of $TiO_2$, as formed by the PEO process.

10. The method according to claim 1, wherein the surface of the metal substrate comprises predominantly aluminium, magnesium, titanium, zirconium, hafnium, tantalum, yttrium, or any other metal which can be subjected to plasma electrolytic oxidation to yield a crystalline oxide coating.

11. The method according to claim 1, wherein the PEO process is further performed in an electrolyte comprising at least one soluble salt of yttrium to provide a source of yttrium for formation of yttria as one of the secondary oxides.

12. The method according to claim 1, wherein the surface of the metal substrate is enriched with the secondary element(s) prior to the PEO processing.

13. The method according to claim 1, wherein the secondary oxide is incorporated into the mixed oxide coating by a secondary, separate step of applying a suspension of the secondary oxide to a surface of the first oxide coating.

14. The method according to claim 13, further comprising an electrophoretic step to promote deposition and incorporation of the suspension onto and into the first oxide coating.

15. The method according to claim 1, further comprising a thermal curing step.

16. The method according to claim 1, wherein a region at or close to the exterior surface of the mixed oxide coating is richer in oxides of the secondary elements than a bulk of the coating.

17. The method according to claim 1, wherein a predetermined exterior surface thickness of the mixed oxide coating is removed subsequent to its formation to adjust a phase proportion of at least the secondary oxide at the exterior surface of the mixed oxide coating.

18. The method according to claim 17, wherein the exterior surface thickness of the mixed oxide coating is removed by at least one of polishing, abrading and ablating.

19. The method according to claim 1, wherein the transition metal is chosen from scandium, zirconium and manganese; the rare earth metal is chosen from tantalum and hafnium; and the lanthanoid is chosen from erbium, dysprosium, lanthanum and cerium.

* * * * *